US007976346B2

(12) United States Patent
Guy et al.

(10) Patent No.: US 7,976,346 B2
(45) Date of Patent: Jul. 12, 2011

(54) INTERFACE CONNECTION MANAGEMENT USING A REMOVABLE ADAPTER FOR COMMUNICATIONS EQUIPMENT

(75) Inventors: Jason Guy, Morrisville, NC (US); Aamer Akhter, Cary, NC (US); Sunil Cherukuri, Morrisville, NC (US); Haseeb Niazi, Morrisville, NC (US); Robert Payment, Cary, NC (US)

(73) Assignee: Cisco Technology, Inc., San Jose, CA (US)

( * ) Notice: Subject to any disclaimer, the term of this patent is extended or adjusted under 35 U.S.C. 154(b) by 179 days.

(21) Appl. No.: 12/399,613

(22) Filed: Mar. 6, 2009

(65) Prior Publication Data

US 2010/0227493 A1 Sep. 9, 2010

(51) Int. Cl.
*H01R 25/00* (2006.01)

(52) U.S. Cl. ..... 439/638; 439/680

(58) Field of Classification Search ..... 439/638, 439/680

See application file for complete search history.

(56) References Cited

U.S. PATENT DOCUMENTS

| | | | | |
|---|---|---|---|---|
| 4,787,040 | A | 11/1988 | Ames et al. | |
| 4,965,460 | A | 10/1990 | Tanaka et al. | |
| 5,161,422 | A | 11/1992 | Suman et al. | |
| 5,222,007 | A | 6/1993 | Suzuki et al. | |
| 5,245,511 | A | 9/1993 | Watanabe | |
| 5,359,230 | A | 10/1994 | Namiki et al. | |
| 5,434,753 | A | 7/1995 | Watanabe | |
| 5,460,547 | A * | 10/1995 | Belt et al. | 439/638 |
| 5,518,416 | A * | 5/1996 | Kantner et al. | 439/352 |
| 5,521,443 | A | 5/1996 | Imura et al. | |
| 5,562,504 | A * | 10/1996 | Moshayedi | 439/638 |
| 5,795,174 | A | 8/1998 | Saito et al. | |
| 5,889,337 | A | 3/1999 | Ito et al. | |
| 5,913,701 | A * | 6/1999 | Olson et al. | 439/668 |
| 6,020,654 | A | 2/2000 | Chutorash | |
| 6,104,101 | A | 8/2000 | Miller et al. | |
| 6,109,978 | A | 8/2000 | Stellman et al. | |
| 6,123,564 | A | 9/2000 | Belmore, III | |
| 6,144,114 | A | 11/2000 | Chutorash | |
| 6,321,340 | B1 * | 11/2001 | Shin et al. | 713/310 |
| 6,343,950 | B1 | 2/2002 | Eginton et al. | |
| 6,547,585 | B2 | 4/2003 | Bradley et al. | |
| 6,724,623 | B2 * | 4/2004 | Bovio et al. | 361/679.45 |

(Continued)

FOREIGN PATENT DOCUMENTS

EP 1267450 A2 12/2002

OTHER PUBLICATIONS

"Package Mechanical Specifications," Intel Corp.; Datasheet, pp. 35-38, Santa Clara, CA.

*Primary Examiner* — James Harvey

(57) ABSTRACT

An interface comprising a docking site having a first electrical connector adapted to interconnect a bus, and having at least one first retainer portion; and an adapter comprising: at least one second retainer portion, wherein the at least one second retainer portion and the at least one first retainer portion are adapted to releasably engage; a second electrical connector, wherein the second electrical connector and the first electrical connector are adapted to engage and interconnect; at least one port adapted to accept at least one modular connector having at least one electrical contact; and at least one electrical interconnect adapted to interconnect the at least one electrical contact with the second electrical connector.

17 Claims, 8 Drawing Sheets

U.S. PATENT DOCUMENTS

| | | | | |
|---|---|---|---|---|
| 6,796,844 | B1 * | 9/2004 | Edwards, III | 439/638 |
| 6,857,900 | B2 | 2/2005 | Kleeberger et al. | |
| 7,001,219 | B2 * | 2/2006 | Dallmeier | 439/638 |
| 7,140,911 | B1 | 11/2006 | Rector et al. | |
| 7,374,447 | B2 * | 5/2008 | Matsumoto | 439/344 |
| 7,381,087 | B2 | 6/2008 | Alvarez | |
| 7,438,577 | B2 * | 10/2008 | Bridges et al. | 439/260 |
| 2006/0046575 | A1 * | 3/2006 | Allen | 439/638 |
| 2010/0227493 | A1 * | 9/2010 | Guy et al. | 439/345 |

* cited by examiner

INTERFACE CONNECTION MANAGEMENT USING A REMOVABLE ADAPTER FOR COMMUNICATIONS EQUIPMENT

BACKGROUND

1. Field

The following generally relates to interface connection management, and more particularly, to interface connection management using a removable adapter for communications equipment.

2. Related Art

Communications systems commonly include spatially separate communications equipment that can be interconnected using one or more ("inter-equipment") cables. In general, each inter-equipment cable terminates to the communications equipment via an interface (i.e., integrated-equipment interface) that is incorporated into, integral to or otherwise integrated into the communications equipment.

In general, the integrated-equipment interface includes a physical interface that allows signals to be exchanged among the communications equipment and the inter-equipment cables. This physical interface generally includes two sets of ports, namely, user-accessible ports and internal ports. The user-accessible ports are adapted, configured, operable or otherwise constructed (collectively "adapted") to terminate the inter-equipment cables. The internal ports, on the other hand, are adapted to terminate one or more ("intra-equipment") cables or wire arrays interconnecting a bus of the communications equipment and the integrated-equipment interface.

In addition to the ports, the integrated-equipment interface includes a number of electrical interconnects (e.g., wires, traces, etc.) that are adapted to appropriately interconnect the user-accessible and internal ports. Using this construction, the signals exchanged among the communications equipment and the inter-equipment cables pass between the user-accessible ports, the electrical interconnects, the internal ports and the intra-equipment cables.

In some environments, sets of the communications equipment can be arranged in respective equipment racks. Advantages of arranging the sets of communication as such include minimizing or effectively utilizing floor space occupied by such communications equipment, reducing lengths of the inter-equipment cables, logically collocating one or more pieces of the communications equipment, etc. In some instances, the racks can be positioned proximate to one another. As such, adhering to proper cable management paradigms is important for (i) efficiently routing the inter-equipment cables to minimize or effectively utilize space occupied by such cables, (ii) preventing damage or unexpected displacement of the inter-equipment cables, (iii) avoiding excessive cable bending or other external forces that are likely to damage the inter-equipment cables and/or their associated terminations.

In legacy communications equipment, the user-accessible ports and the inter-equipment cables are configured in accordance with standards for registered jacks, such as RJ45, RJ11 and the like. Thus, the inter-equipment cables terminate to respective plugs (or, alternately, jacks) and the user-accessible ports terminate to respective complementary jacks (or, alternatively, plugs). This way, the inter-equipment cables "plug into" the user-accessible ports for interconnection, instead of having to hardwire terminations of the inter-equipment cables and the user-accessible ports. A major advantage of using plugs and jacks is that to connect and disconnect the inter-equipment cables from the user-accessible ports requires only inserting and removing the plugs from the jacks (or vice versa), respectively. Thus, when the legacy communications equipment needs to be serviced and/or replaced, the inter-equipment cables can be disconnected from the corresponding user-accessible ports by removing the plugs from the jacks.

However, to keep track of the correspondence between the inter-equipment cables and the user-accessible ports for reconnection, each of the inter-equipment cables and/or user-accessible ports need to be labeled prior to disconnection. In addition, the configuration (e.g., order of removal/insertion and location) of the inter-equipment cables needs to be recorded or otherwise noted to ensure adherence to the aforementioned cable management paradigms. Otherwise, additional downtime of the communications equipment may result from needing to spend time determining the correspondence and for reconfiguring the inter-equipment cables to ensure adherence to the aforementioned cable management paradigms. Whether keeping track of the correspondence and/or configuration prior to disconnection or determining the correspondence and/or configuration subsequent to disconnection, the communications equipment remains unusable for the time spent doing so.

Therefore, there is a need in the art for interface connection management using a removable adapter for communications equipment, which, for example, obviates the need to individually disconnect and reconnect inter-equipment cables to service and/or replace the communications equipment.

BRIEF DESCRIPTION OF THE DRAWINGS

The teachings of the present invention can be readily understood by considering the following detailed description in conjunction with the accompanying drawings.

The figures in the appended drawings, like the detailed description, are examples. As such, the figures and the detailed description are not to be considered limiting, and other equally effective examples are possible and likely. Furthermore, like reference numerals in the figures indicate like elements, and wherein.

DESCRIPTION OF EXAMPLE EMBODIMENTS

Overview

Embodiments of the present invention include an interface comprising a docking site having a first electrical connector adapted to interconnect a bus, and having at least one first retainer portion; and an adapter comprising: at least one second retainer portion, wherein the at least one second retainer portion and the at least one first retainer portion are adapted to releasably engage; a second electrical connector, wherein the second electrical connector and the first electrical connector are adapted to engage and interconnect; at least one port adapted to accept at least one modular connector having at least one electrical contact; and at least one electrical interconnect adapted to interconnect the at least one electrical contact with the second electrical connector.

Additional embodiments of the invention include an adapter comprising at least one first retainer portion adapted to releasably engage with at least one second retainer portion of a docking site; a first electrical connector adapted to engage and interconnect a second electrical connector of the docking site; at least one port adapted to accept at least one modular connector having at least one electrical contact; and at least one electrical interconnect adapted to interconnect the at least one electrical contact with the first electrical connector, wherein the adapter is operable to exchange a signal between the at least one second connector and the at least one modular connector when the at least one first retainer portion and the at least one second retainer portion are releasably engaged.

DETAILED DESCRIPTION

In the following detailed description, numerous specific details are set forth in order to provide a thorough understanding of exemplary embodiments or other examples described herein. However, it will be understood that these embodiments and examples may be practiced without the specific details. In other instances, well-known methods, procedures, components and circuits have not been described in detail, so as not to obscure the following description. Further, the embodiments and/or examples disclosed are for exemplary purposes only and other embodiments and/or examples may be employed in lieu of or in combination with the embodiments disclosed.

Figure 1A:
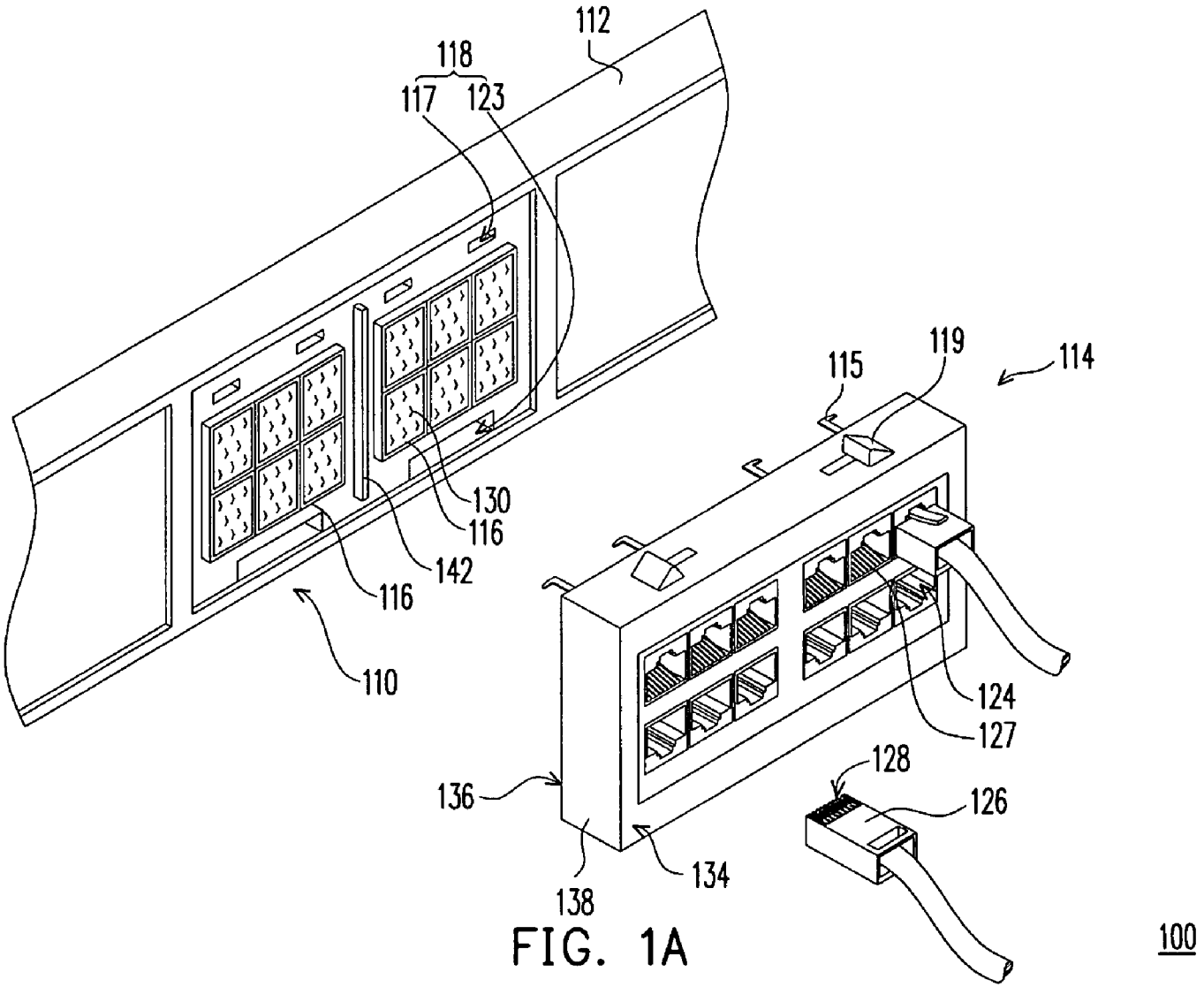
FIG. 1A is a first isometric plan view diagram illustrating an embodiment of an interface having a removable adapter.
Figure 1B:
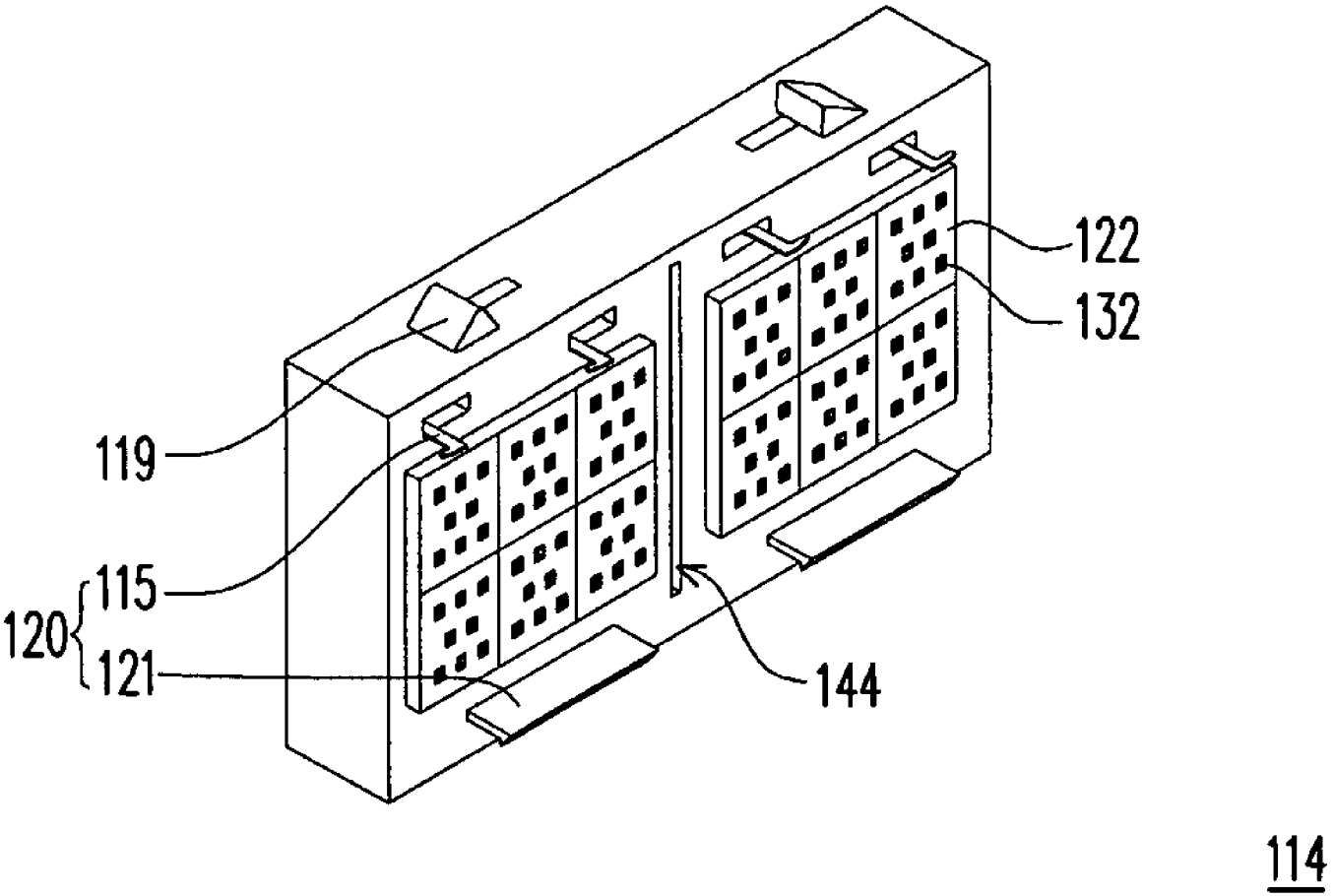
FIG. 1B is a second isometric plan view diagram illustrating an embodiment of an interface having a removable adapter.
Figure 1C:
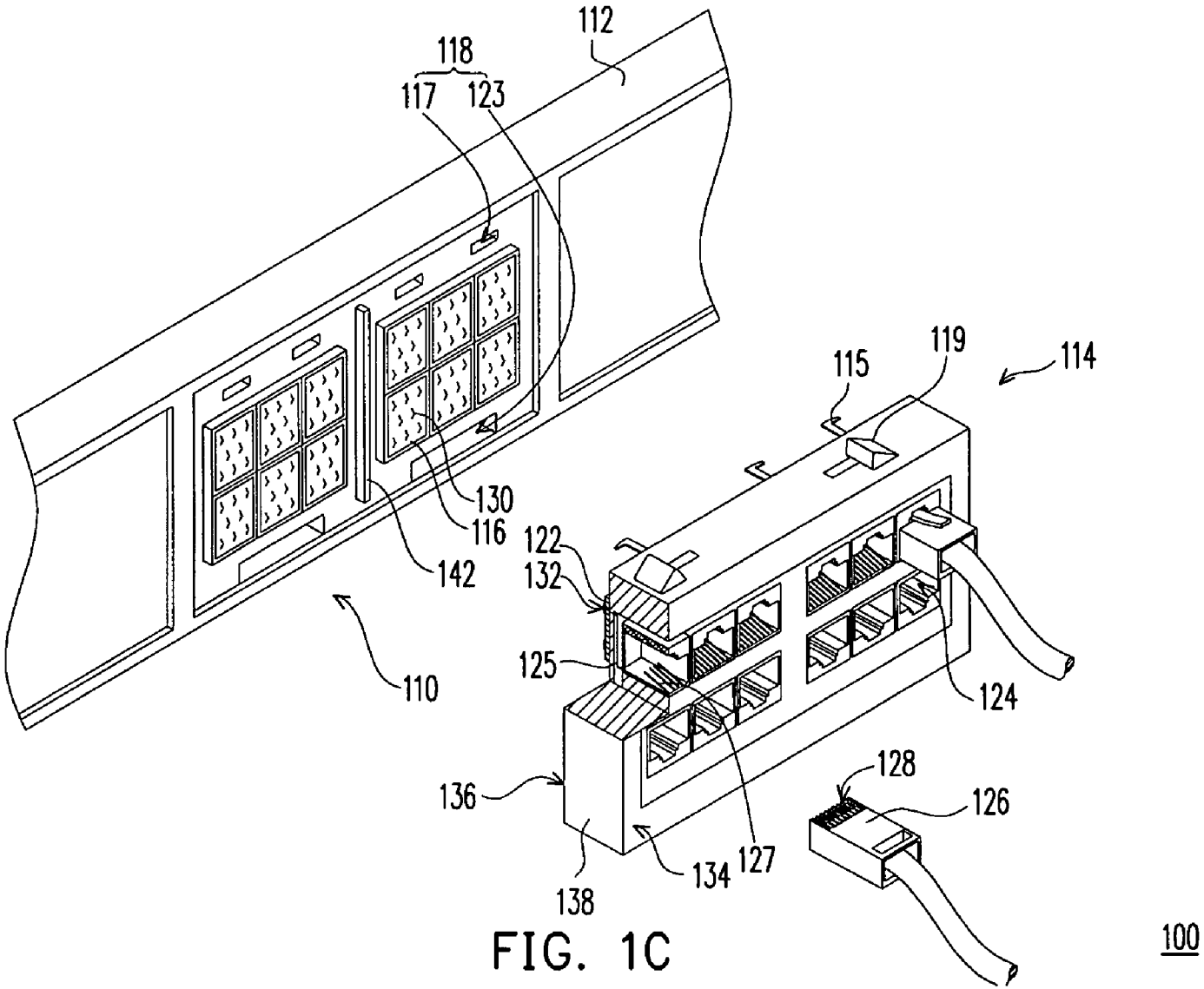
FIG. 1C is a third isometric plan view diagram illustrating a cut-away of an embodiment of a removable adapter in combination with an embodiment of the interface.
Figure 1D:
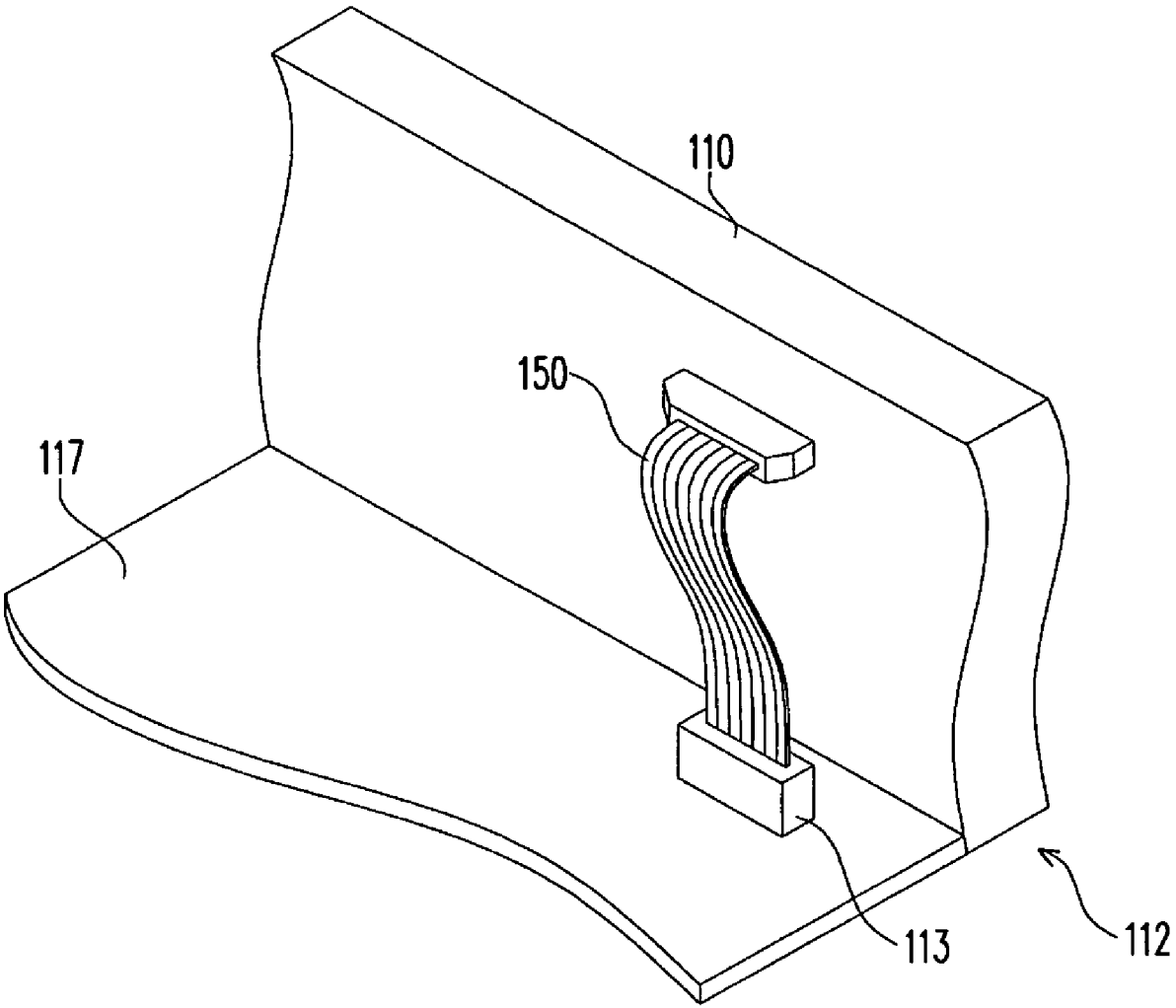
FIG. 1D is a fourth isometric plan view diagram illustrating an embodiment of an interface having a removable adapter.

FIGS. 1A-1D are plan view diagrams illustrating an embodiment of an interface 100 for communication equipment 112. The interface 100 includes a docking site 110 of communications equipment 112 and an adapter 114. The docking site 110 may include a plurality of retainer portions ("dock-retainer portions") 118 and an electrical connector ("dock-electrical connector") 116. The dock-electrical connector 116 interconnects, via an intra-equipment cable 150, to a bus 113 of the communications equipment 112 (FIG. 1D). The cable 150 may be a flexible cable or an array of solid wires.

The adapter 114 includes a plurality of retainer portions ("adapter-retainer portions") 120, an electrical connector ("adapter-electrical connector") 122, a plurality of ports ("adapter ports") 124 and a plurality of electrical interconnects ("adapter interconnects") 125. The adapter-electrical connector 122 and dock-electrical connector 116 have respective form factors that are adapted to engage (e.g., mate), interconnect and cause interconnection between electrical contacts thereof when the adapter 114 is attached to the docking site 110.

Each of the adapter-electrical connector 122 and the dock-electrical connector 116 may be segregated into two portions; each of which may be partitioned into six sub-portions. Being segregated into two portions may limit engagement (i.e., insertion) forces and/or limit or prevent damage to the electrical contacts of the adapter-electrical connector 122 and the dock-electrical connector 116. Further segregation may further limit engagement forces and/or limit or prevent damage to the electrical contacts of the adapter-electrical connector 122 and the dock-electrical connector 116. Although six sub-portions are shown, the connector may be partitioned into 2, 4, 6 or more sub-portions. As more or less sub-portions are used, the number of adapter retainer portions can be selected to ensure an appropriate force is exerted on the connector to ensure a sufficient electrical connection is maintained.

Each of the sub-portions of the contacts of the dock-electrical connector 116 may include a plurality of spring-loaded pins ("dock-connector pins") 130, and each of the sub-portions of the adapter-electrical connector 122 may include a plurality of contacts ("adapter-connector contacts") 132. The dock-connector pins 130 are adapted to engage (e.g., mate) and interconnect with the adapter-connector contacts 132. Examples of the dock-connector pins 130 and the adapter-connector contacts 132 include spring-loaded pins and corresponding contacts akin to pins and contacts of a microprocessor socket, such as LGA775. The dock-connector pins 130 are adapted to engage (e.g., mate) and interconnect with the adapter-connector contacts 132 allow for high speed data connections between the adapter-electrical connector 122 and the dock-electrical connector 116 when the adapter 114 is engaged with the docking site 110.

The adapter-retainer portions 120 and the dock-retainer portions 118 are adapted to releasably engage, such that the adapter 114 may be attached to and detached from the docking site 110 by releasing the engagement between the adapter-retainer portions 120 and the doc-retainer portions 120.

To facilitate the releasable engagement, the adapter-retainer portions 120 may include a plurality of spring-loaded latches 115 (e.g., hooks), and the first retainer portions 118 include a respective plurality of keepers 117 (e.g., apertures) that are adapted to accept and to releasably engage the spring-loaded latches 115. To further facilitate the releasable engagement, the adapter-retainer portions 120 may include two keys 121, and the dock-retainer portions 118 may include two keyholes 123 adapted to accept and releasably engage the keys 121.

The adapter 114 may further include two ejectors 119. These ejectors 119 are adapted to release engagement of the adapter-retainer portions 120 from the first retainer portions 118. Each of the ejectors 119 may be positioned on the top of the adapter 114 and arranged to drive a pair of latches 115. Although the ejectors 119 are depicted in this embodiment as being located on the body 138 of the adapter 114, the ejectors could alternatively be located on the docking site 110.

To attach the adapter 114 to the docking site 110, the keys 121 may be first inserted into the keyholes 123 on the docking site 110. Next, the top of the adapter 114 is folded towards the docking site 110 to cause an initial engagement of surfaces of the spring-loaded latches 115 with the keepers 117. The surfaces of the spring-loaded latches 115 slide along the keepers 117 until the adapter 114 is seated, whereupon the springs of the spring-loaded latches 115 latch to the keepers 117 (e.g., after enough pressure is applied).

To detach the adapter 114 from the docking site 110, the two ejectors 119 are forced toward the center of the adapter to cause disengagement of the latches 115 from the keepers 117. After disengagement, the top side of the adapter 114 may be separated from the docking site 110. The adapter 114 is then elevated or rotated to cause separation of the keys 121 from the keyholes 123, thereby causing removal from the docking site 110.

In addition to the foregoing, the adapter 114 includes a first side 134, a second side 136 and a body 138 disposed between the first and second sides 134, 136. At least a portion of the adapter ports 124 is disposed in the body 138 from the first side 134, and at least a portion of the adapter-electrical connector 122 is disposed in the body 138 from the second side 136.

Each of the ports 124 is adapted to accept one modular connector 126 having one or more electrical contacts ("modular-connector contacts") 128. The ports 124 and the modular connectors 126 may be formed in accordance with a standard for registered jacks, such as RJ-45 plugs and RJ-45 sockets. Specifically, as shown in FIG. 1C, each of the ports 124 includes one or more electrical contacts ("port contacts") 127, such as eight contacts of RJ-45 socket.

The adapter-electrical interconnects 125 are disposed within the body 138, and electrically interconnect the adapter-electrical connector 122 and the ports 124. To facilitate this, the adapter-electrical interconnects 125 interconnect port contacts 127 with the adapter-connector contacts 132.

When inserted into corresponding ports 124, the modular-connector contacts 128 of the modular connectors 126 couple to the port contacts 127, and via the adapter-electrical interconnects 125, provide paths for signals to pass to the contacts of the adapter-electrical connector 122. And when the adapter 114 is engaged with the docking site 110, such signals may pass to the dock-connector pins 130, and on to the bus 113 of the communications equipment 112.

Although, as shown, the ports 124 and the modular connectors 126 are formed in accordance with standards for registered jacks, the scope of the present invention is not limited thereto. In addition, the ports 124 may comprise two or more types of ports such as a first port and a second port, and the modular connectors can comprise two or more types of modular connectors, such as a first modular connector and a second modular connector. The first port and the first modular connector may be formed in accordance with a first standard for registered jacks, and the second port and the second modular connector are formed in accordance with a second standard for registered jacks.

Furthermore, the docking site 110 may further include one or more alignment portions ("dock-alignment portions") 142, and the adapter 114 may further include one or more alignment portions ("adapter-alignment portions") 144 that correspond to the dock-alignment portions 142 on the docking site 110. The dock-alignment portion may be for example, a key, and the adapter-alignment portion 144 may be keyhole. The dock-alignment portion 142 and the second alignment portion 144 are adapted to cause an alignment between the docking site 110 and the adapter 114 to cause the dock-connector pins 130 to appropriately align with the adapter-connector contacts 132 when the adapter 114 is attached to the docking site 110.

An interface connection management using a removable adapter for communications equipment according to an embodiment of the present invention is described above. However, the present invention is not limited thereto, wherein types or arrangement of the aforementioned elements such as the electrical connectors, the ejectors, the retainer portions, the alignment portions, the hosts, and the modular connectors are variable and can be modified according to practical necessaries.

Figure 2:
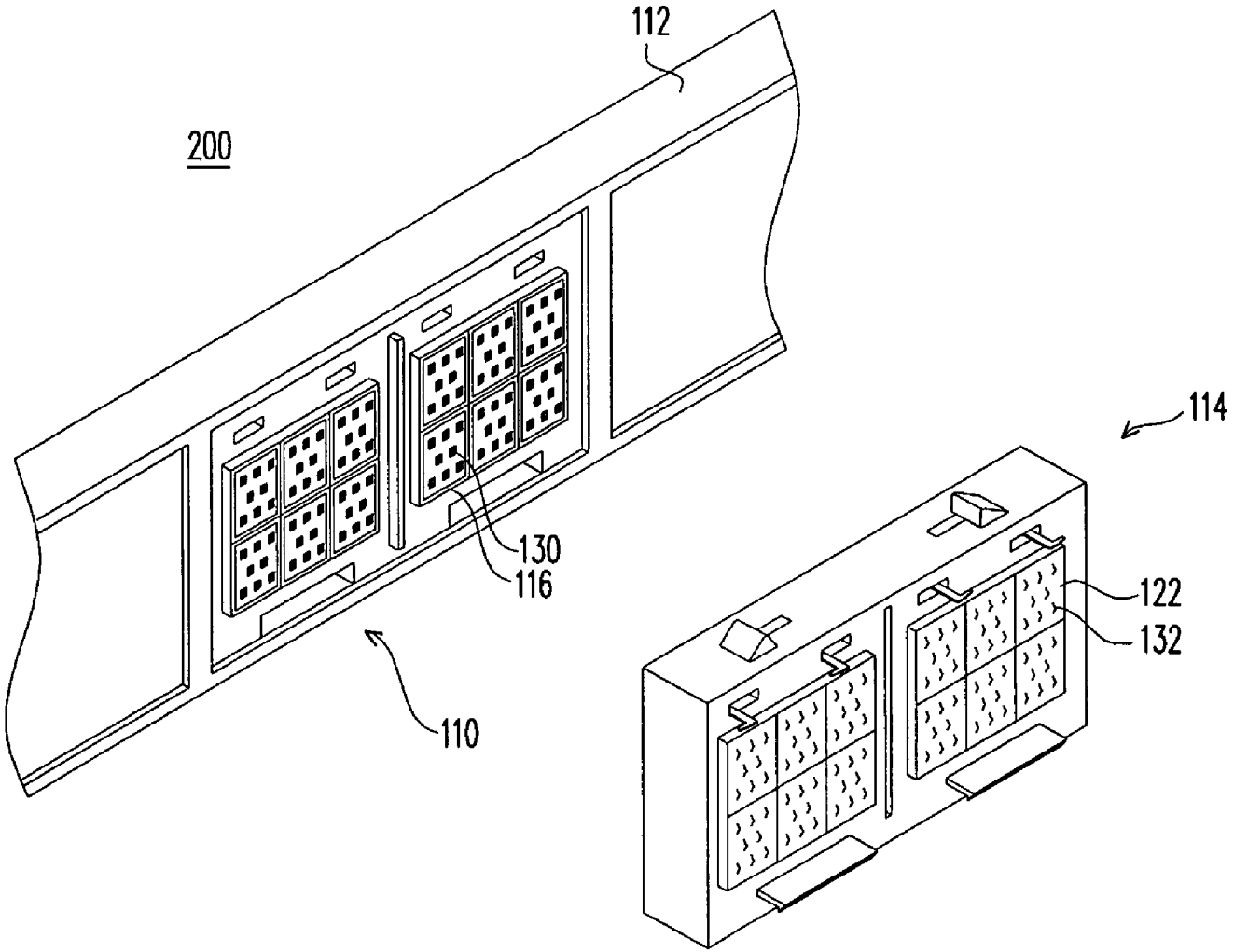
FIG. 2 is an isometric plan view drawing illustrating a second embodiment of the interface having a removable adapter.

Referring now to FIG. 2, an isometric plan view drawing illustrating an example interface 200 having a removable adapter is shown. The interface 200 of FIG. 2 is similar to the interface 100 of FIG. 1, except as described herein below. As shown, the adapter-electrical connector 122 includes spring-loaded pins 132 instead contacts, and the dock-electrical connector 116 includes contacts that mate to the spring-loaded pins, as opposed to the spring loaded pins.

Figure 3:
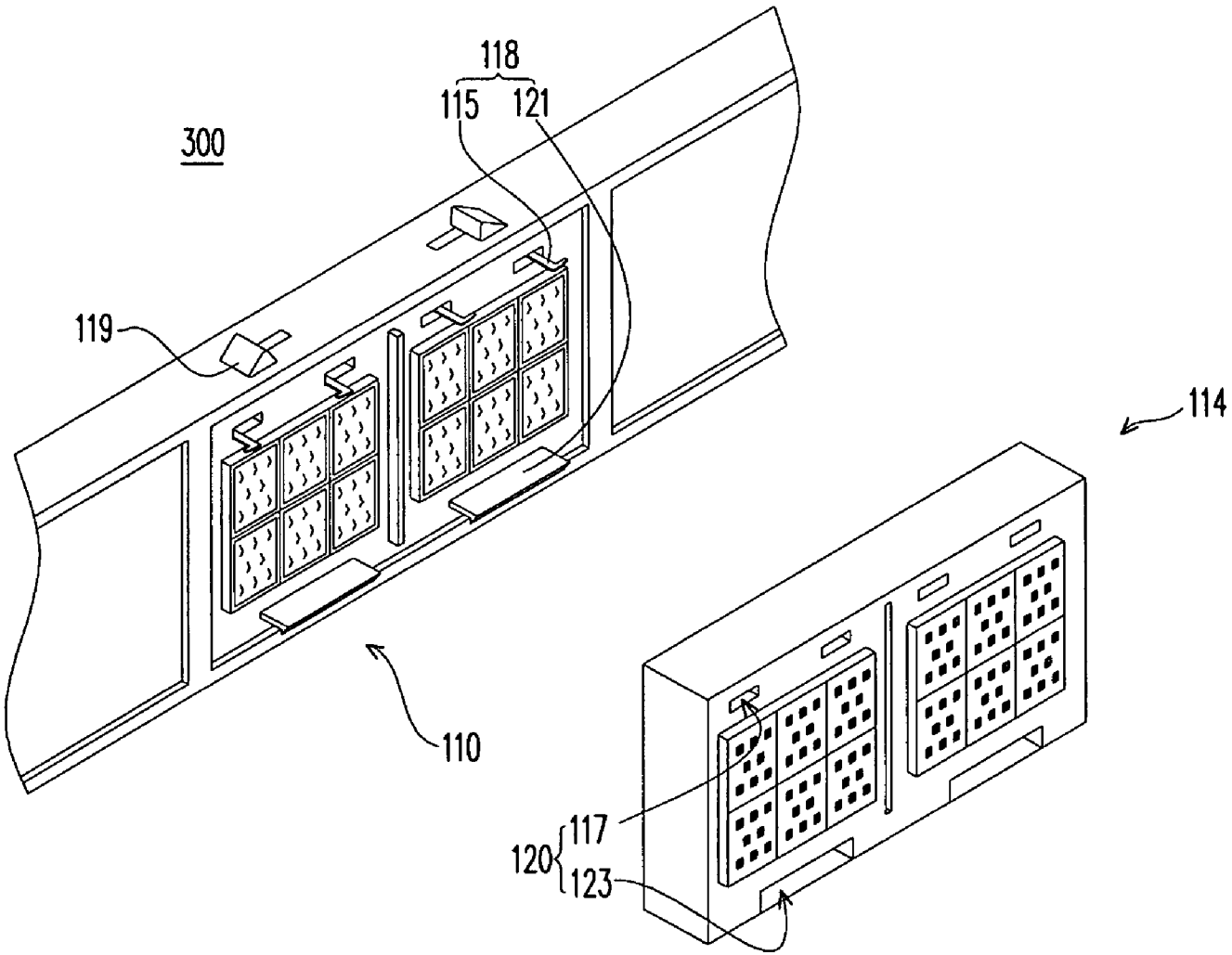
FIG. 3 is an isometric plan view drawing illustrating a third embodiment of the interface having a removable adapter.

FIG. 3 is an isometric plan view drawing illustrating an example interface 300 having a removable adapter. The interface 300 of FIG. 3 is similar to the interface 100 of FIG. 1, except as described herein below. In comparison with the interface 100 shown in FIGS. 1A-1D, the arrangement of the ejectors 119, dock-retainer portions 118 and the adapter-retainer portions 120 is reverse of the similar arrangement shown in FIG. 1. More specifically, the dock-retainer portions 118 include latches 115 and keys 121, and the adapter-retainer portions 120 include keepers 117 that are adapted to releasably engage the latches 115, and keyholes 123 that are adapted to releasably engage the keys 121. To attach the adapter 114 to the docking site 110, the keys 121 and the keyholes 123 are engaged prior to the latches 115 and the keepers 117 being engaged. Furthermore, to release the engagement of the second retainer portion 120 and the first retainer portion 118, the ejectors 119 are arranged on the top of the docking site 110 for driving pairs of the latches 115.

Figure 4:
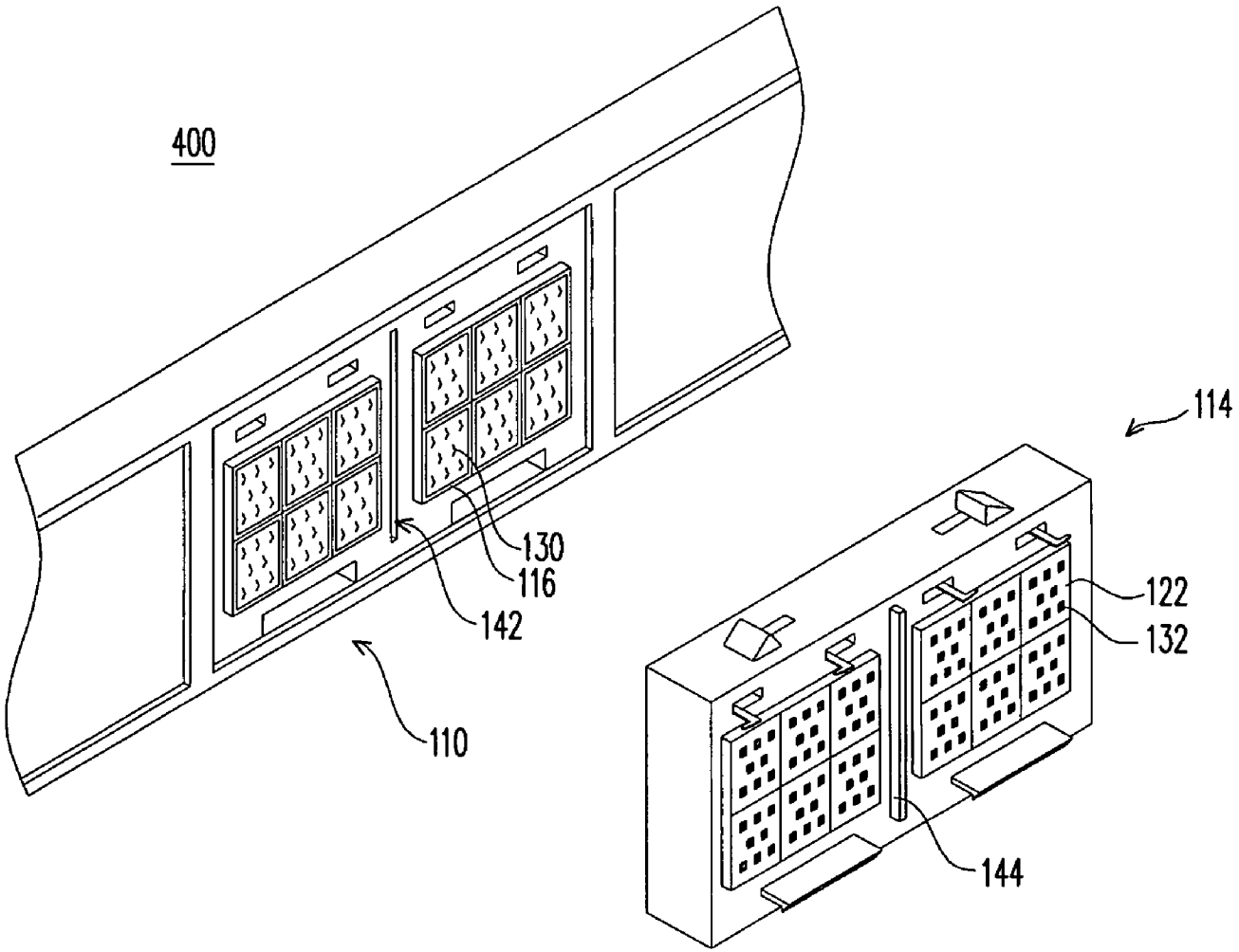
FIG. 4 is an isometric plan view drawing illustrating a fourth embodiment of the interface having a removable adapter.

Referring now to FIG. 4, an isometric plan view drawing illustrating an example interface 400 having a removable adapter is shown. The interface 400 of FIG. 4 is similar to the interface 100 of FIG. 1, except as described herein below. In comparison with the interface 100 shown in FIGS. 1A-1D, the interface 400 includes dock-alignment portion 142 and adapter-alignment portion 144 are reversed from the dock-alignment portion 142 and adapter-alignment portion 144. As shown, the dock-alignment portion 142 is a keyhole and the adapter-alignment portion 144 is a key. As above, the dock-alignment portion 142 and adapter-alignment portion 144 allow for alignment of the dock-connector pins 130 with the adapter-connector contacts 132 when the adapter 114 is attached to the docking site 110.

Figure 5:
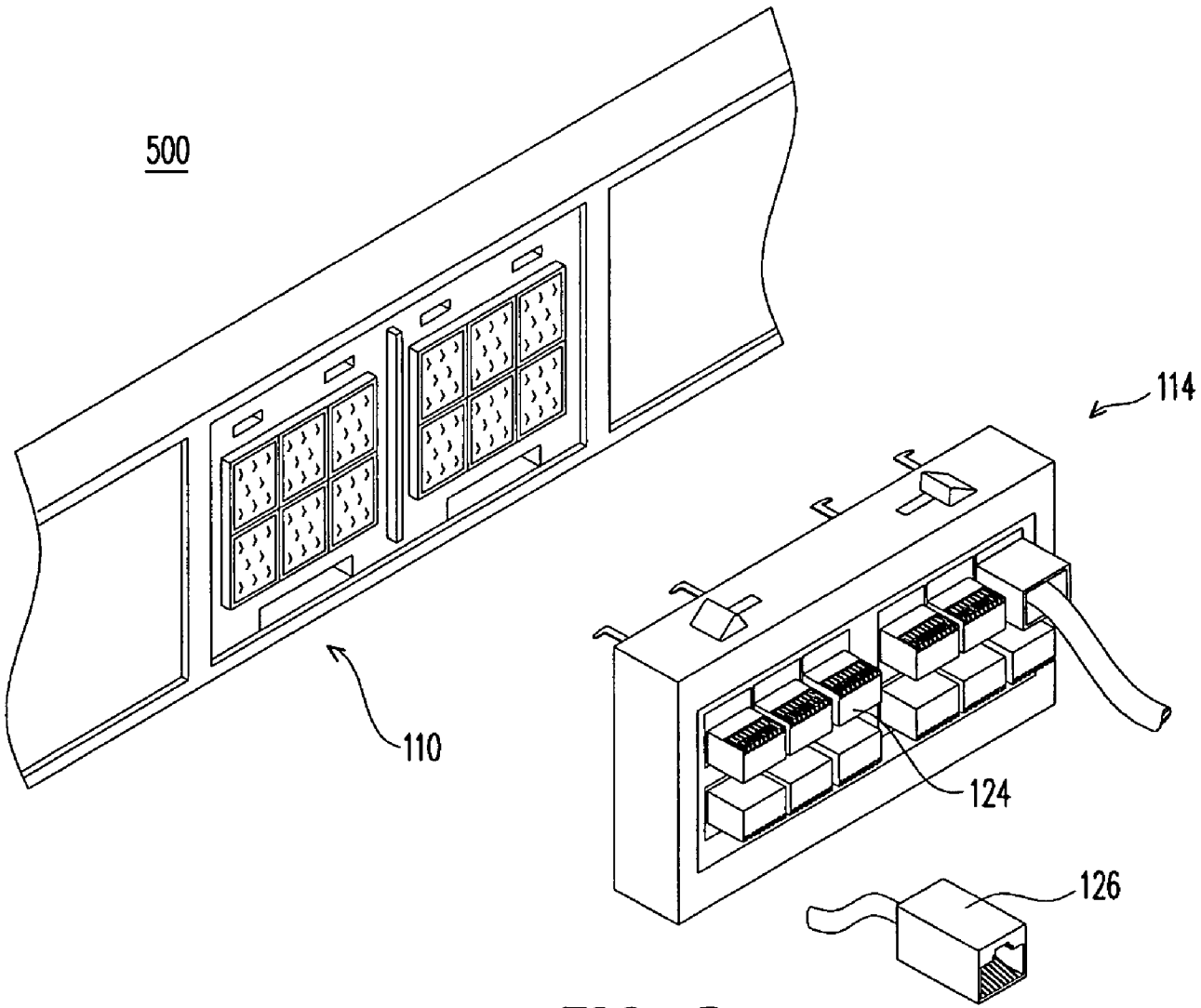
FIG. 5 is an isometric plan view drawing illustrating a fifth embodiment of the interface having a removable adapter.

FIG. 5 is an isometric plan view drawing illustrating an example interface 500 having a removable adapter. The interface 500 of FIG. 5 is similar to the interface 100 of FIG. 1, except as described herein below. In comparison with the interface 100 shown in FIGS. 1A-1D, the adapter 114 includes adapter ports 124 that are adapted to accept and interconnect with modular connectors 126 in the form of sockets, instead of plugs. As shown, the adapter ports 124 and the modular connectors 126 are formed in accordance with a standard for registered jacks, such as RJ-45 plugs and RJ-45 sockets, respectively. When coupling the modular connectors 126 to the adapter ports 124, the RJ-45 plugs interconnect to the RJ-45 sockets such that each modular connector 126 is electrically connected with the adapter-electrical connector (not shown).

It should be noted that, detailed structures or steps exemplified according to the above different embodiments can be combined, replaced or omitted under reasonable circumstances to meet different practical needs. A person having ordinary skill in the art should comprehend the spirits and the technical features of the present invention after studying the above embodiments, and can perform reasonable modifications and applications without departing from the scope of the present invention.

In summary, the interface illustrated in the above embodiments provides connection management using a removable adapter for communications equipment. These as well as other embodiments preserve native flexibility of connecting individually to any port, while providing additional ability to remove and maintain all connections together, in the event of communications equipment such as a catastrophic line card or a switch failure. The present invention extends such native function of the interface by allowing for a single cable to be removed from the interface without disrupting the remaining connections. This way, when one port fails while utilizing the interface, its connection can be easily disconnected from the adapter, and/or connected to a different port without disrupting service of the other connections.

Although not shown, the adapter can be secured to the docking site communications equipment using an external locking mechanism. Such a locking mechanism may include a spring-loaded lock, screws and/or other fasteners. In addition, the adapter may be releasably engaged to the docking without connections to the inter-network cables.

The interface of the present invention can be easily made into a marketable option for switch products, or provided as a cable management part. Furthermore, the adapter can be adapted for such, as a switch or a line card of any kind of communications equipment, including fiber optic connections.

While the foregoing is directed to embodiments of the present invention, other and further embodiments of the invention may be devised without departing from the basic scope thereof, and the scope thereof is determined by the claims that follow.

What is claimed is:

1. An interface comprising:

a docking site having a first electrical connector adapted to interconnect a bus and having at least one first retainer portion; and an adapter comprising:

at least one second retainer portion, wherein the at least one second retainer portion and the at least one first retainer portion are adapted to releasably engage, wherein one of the at least one first retainer portion or the at least one second retainer portion comprises at least one key, and the other of the at least one first retainer portion or the at least one second retainer portion comprises at least one keyhole, the at least one key adapted to releasably engage the at least one keyhole;

a second electrical connector, wherein the second electrical connector and the first electrical connector are adapted to engage and interconnect, wherein, to cause engagement of the docking site and the adapter, the at least one key and the at least one keyhole are engaged prior to the first electrical connector and the second electrical connector being engaged;

at least one port adapted to accept at least one modular connector having at least one electrical contact; and at least one electrical interconnect adapted to interconnect the at least one electrical contact with the second electrical connector.

2. The interface of claim 1, wherein the first electrical connector comprises at least one spring-loaded pin, wherein the second electrical connector comprises at least one contact, and wherein the at least one spring-loaded pin and the at least one contact are adapted to engage and interconnect.

3. The interface of claim 1, wherein the first electrical connector comprises at least one contact, wherein the second electrical connector comprises at least one spring-loaded pin, and wherein the at least one contact and the at least one spring-loaded pin are adapted to engage and interconnect.

4. The interface of claim 1, wherein the at least one port and the at least one modular connector are formed in accordance with a standard for registered jacks.

5. The interface of claim 1, wherein the adapter comprises first and second sides and a body disposed therebetween, wherein at least a portion of the at least one port is disposed in the body at the first side, and wherein at least a portion of the second electrical connector is disposed in the body at the second side.

6. The interface of claim 1, wherein the adapter or the docking site further comprises at least one ejector adapted to release engagement of the at least one second retainer portion and the at least one first retainer portion.

7. The interface of claim 1, wherein the at least one second retainer portion further comprises at least one latch, wherein the at least one first retainer portion further comprises at least one keeper, and wherein the at least one latch is adapted to releasably engage the at least one keeper.

8. The interface of claim 7, wherein the at least one second retainer portion comprises at least one key, and the at least one first retainer portion comprises the at least one keyhole.

9. The interface of claim 7, wherein, to cause engagement of the docking site and the adapter, the at least one key and the at least one keyhole are engaged prior to the at least one latch and the at least one keeper being engaged.

10. The interface of claim 1, wherein the at least one first retainer portion comprises at least one latch, wherein the at least one second retainer portion comprises at least one keeper, and wherein the at least one latch is adapted to releasably engage the at least one keeper.

11. The interface of claim 10, wherein the at least one first retainer portion comprises the at least one key, and the at least one second retainer portion comprises the at least one keyhole.

12. The interface of claim 11, wherein, to cause engagement of the docking site and the adapter, the at least one key and the at least one keyhole are engaged prior to the at least one latch and the at least one keeper being engaged.

13. The interface of claim 1, wherein the docking site further comprises at least one first alignment portion, wherein the adapter further comprises at least one second alignment portion, and wherein the at least one first alignment portion and the at least one second alignment portion are adapted to cause an alignment between the docking site and the adapter.

14. The interface of claim 1, wherein the first electrical connector comprises first and second connector portions, wherein the second electrical connector comprises third and fourth connector portions, and wherein the first and second connector portions are adapted to engage and interconnect with the third and fourth connector portions, respectively.

15. The interface of claim 1, wherein the at least one port comprises first and second ports, wherein the at least one modular connector comprises first and second modular connectors, wherein the first port and the first modular connector are formed in accordance with a first standard for registered jacks, and wherein the second port and the second modular connector are formed in accordance with a second standard for registered jacks.

16. An adapter comprising:

at least one first retainer portion adapted to releasably engage with at least one second retainer portion of a docking site, wherein the at least one first retainer portion comprises a key adapted to releasably engage a keyhole of the at least one second retainer portion of the docking site;

a first electrical connector adapted to engage and interconnect a second electrical connector of the docking site, wherein, to cause engagement of the adapter to the docking site, the key and the keyhole are engaged prior to the first electrical connector and the second electrical connector being engaged;

at least one port adapted to accept at least one modular connector having at least one electrical contact; and at least one electrical interconnect adapted to interconnect the at least one electrical contact with the first electrical connector, wherein the adapter is operable to exchange a signal between the at least one second connector and the at least one modular connector when the at least one first retainer portion and the at least one second retainer portion are releasably engaged.

17. The adapter of claim 16, further comprising at least one ejector adapted to release engagement of the at least one first retainer portion from the at least one second retainer portion.

* * * * *